United States Patent [19]

Kataoka

[11] 4,184,307

[45] Jan. 22, 1980

[54] DEVICE FOR WRAPPING THE ENDS OF ROLLS

[76] Inventor: Hiroshi Kataoka, 5-8 Asahi 1 chome, Iyo-Mishima-shi, Ehime-ken, Japan

[21] Appl. No.: 939,489

[22] Filed: Sep. 5, 1978

[51] Int. Cl.[2] ..... B65B 7/14

[52] U.S. Cl. ..... 53/380

[58] Field of Search ..... 53/380, 211

[56] References Cited

U.S. PATENT DOCUMENTS

| | | | |
|---|---|---|---|
| 3,200,564 | 8/1965 | Lagesse | 53/380 |
| 3,296,772 | 1/1967 | Barker | 53/380 |

*Primary Examiner*—Travis S. McGehee

*Attorney, Agent, or Firm*—Oblon, Fisher, Spivak, McClelland & Maier

[57] ABSTRACT

Disclosed is a device for wrapping up the ends of a roll in a wrapping paper which has been wrapped to encircle the roll and which being longer than the roll extends cylindrically from both ends thereof, which device is characterized by having a plurality of tucking members disposed at given intervals on the outer peripheral surface of the wrapping paper extending from the ends of the roll and by having a plurality of projecting members disposed on the inner peripheral surface of the wrapping paper spaced to fall one between each adjacent pair of tucking members. By moving the plurality of tucking members toward the center of the roll and at the same time gradually drawing in the plurality of projecting members, the extended portion of wrapping paper is formed with alternate ridge portions and groove portions and is pressed onto the ends of the roll. The portions of the wrapping paper which stop up the center hole of the roll when the formed ridge portions are flattened in one direction are pushed into the center hole of the roll.

3 Claims, 14 Drawing Figures

DEVICE FOR WRAPPING THE ENDS OF ROLLS

BACKGROUND OF THE INVENTION

This invention relates to a wrapping device and more particularly to a device for wrapping rolls to cover their ends as well as their sides.

There have hitherto been known two methods for wrapping the ends of rolls. In one method a wrapping paper is wound with its ends slightly projected from the ends of the rolls and this projected cylindrical portion of the wrapping paper is tucked gradually towards the center of the ends of the roll as the roll is rotated and a separate circular piece of wrapping paper is pasted thereon (U.S. Pat..No. 2,368,213). In the other method a wrapping paper is wound with its ends projected by at least a length equal to the radius of roll, then the projected wrapping paper is twisted by rotating the roll and pushed into the hole at the center of the roll.

The former method produces a good appearance because the ends of the roll are covered with a circular piece of wrapping paper. However, it has a fault in that the process of pasting on the circular piece of wrapping paper is troublesome and that it closes up the center hole of the roll, making it inconvenient to transport.

The latter method is simpler in its process than the former. However, it may impair the quality and appearance of the roll by the formation of irregular wrinkles on the wrapped ends. Therefore, it is used mainly for rolls of small diameter.

As methods for overcoming the defect of the latter method, the inventor previously proposed a first method of wrapping about a roll a paper pre-processed to have folds in the portions destined to extend cylindrically from the ends of the roll and then winding the folded portion and tucking it into the center of the roll (Japanese Patent Disclosure No. 13984/77), and a second method wherein tucking members are positioned at equal spaces on the periphery at the ends of the rolls, the cylindrical portions of wrapped paper extending from the ends of the rolls are depressed towards the center of roll so that ridge portions are formed, whereafter the center portion of the wrapping paper is pushed into the center of the rolls and the ridge portions are laid in a fixed direction (Japanese Patent Disclosure No. 70691/77).

These methods proposed by the inventor have some defects in that the pitch of the folds on the wrapping paper have to be changed as the diameter of the roll to be wrapped is altered, or that the projected cylindrical portion of the wrapping paper cannot always be folded evenly with the tucking members because the projected portion does not always maintain a perfectly circular shape.

An object of the present invention is to provide a device for wrapping the ends of rolls neatly by producing even folds.

Another object of the invention is to provide a device for wrapping the ends of rolls, which is easily applicable to rolls having a large diameter without closing up the center hole of the rolls.

The term "roll" used herein means cylinders of such materials as sheet metal, paper and textile having a hole at the center.

SUMMARY OF THE INVENTION

In order to attain the objects mentioned above, the device for wrapping up the ends of a roll in a wrapping paper which has been wrapped to encircle the roll and which being longer than the roll extends cylindrically from both ends thereof according to this invention comprises a set of tucking members at either end of said roll, said tucking members being disposed at given intervals on the outer peripheral surface of said wrapping paper extending cylindrically from the ends of said roll, wrapping paper operation means for simultaneously moving said tucking members toward the center of the ends of said roll, a set of projecting members at either end of said roll, said projecting members being disposed on the inner peripheral surface of said cylindrically protruding wrapping paper at positions falling between the tucking members, means for simultaneously puckering up said projecting members in proportion as said tucking members are moved toward the center of The ends of said roll and for causing said projecting members to escape from the inner surface of said cylindrically protruding wrapping paper before said tucking members come into contact with the ends of said roll, means for laying flat the wrapping paper ridged between the adjacent tucking members by said projecting members when said tucking members come into contact with the ends of said roll, and means for pushing into a central hole of said roll the portions of said wrapping paper which stop up said central hole when said ridged portions are laid in one direction.

The device for wrapping the ends of rolls according to this invention has tucking and projecting members alternately positioned on the inside and outside of the cylinder of wrapping paper projecting from the ends of the roll, and when the tucking members are caused to turn towards the center of the ends of the roll, the excess wrapping paper between the tucking members is tucked in by the projecting members, so that ridge-shaped portions are maintained. Therefore, neat folds are made on the ends of the roll, and further, the excess wrapping paper near the center of the roll is pushed into the center hole without closing it up.

This device for wrapping the ends of rolls is especially suitable for rolls having a large diameter.

Other objects and features of this invention are explained in detail below in reference to the attached drawings.

DESCRIPTION OF THE PREFERRED EMBODIMENTS

Figure 1:
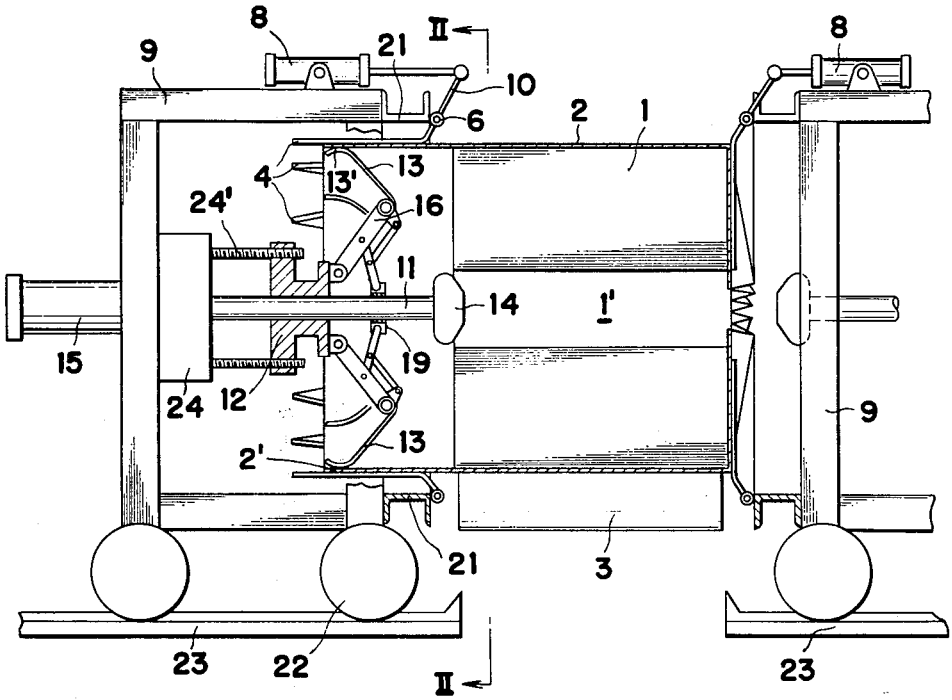
FIG. 1 is a front view, partially in cross section, of the device for wrapping the ends of rolls according to this invention.

FIG. 1 shows one embodiment of the device for wrapping the ends of rolls according to this invention.

At first, a roll 1 to be wrapped is rotated by rollers 3, (rotation and support mechanisms not shown) to have several wrappings of a wrapping paper 2 wound thereon so as to project from the ends of the roll 1. Consequently, the end portion 2' of the wrapping paper projects cylindrically from both ends of the roll 1. The length of the projected wrapping paper 2' should be slightly larger than the radius of the roll.

Figure 2:
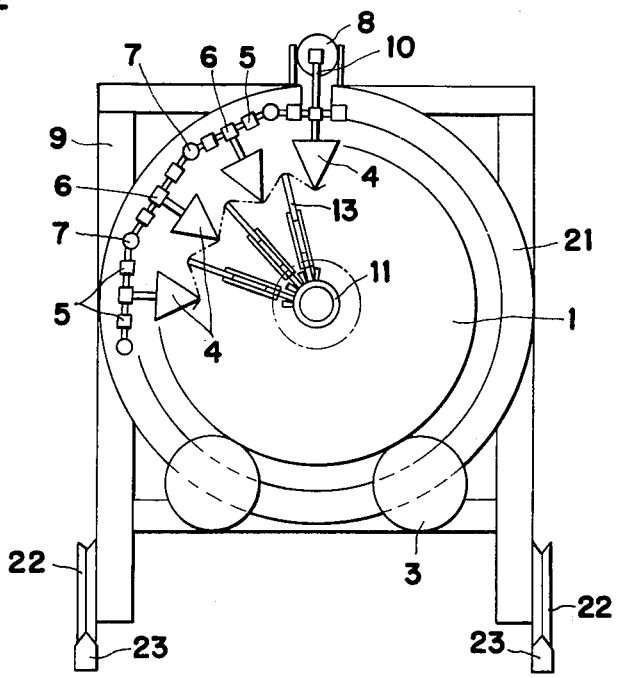
FIG. 2 is a sectional view of the device in FIG. 1.

At either end of the roll 1, there is provided a device for wrapping that end of the roll. As the devices are identical only one of them will be described. The device is mounted on a frame 9 and is adjusted to a prescribed distance from the end of the roll by moving the frame 9 supported by wheels 22 along a rail 23. A cylindrical frame 21 having a slightly larger diameter than that of the roll to be wrapped is provided on the frame 9. The cylindrical frame 21 has a number of tucking members 4 for tucking in the projected portion of the wrapping paper 2' placed at equal intervals about the circumference thereof. A fulcrum supporting shaft 6 for each tucking member 4 is supported by a bearing 5 fixed on the side of the cylindrical frame 21. The fulcrum supporting shafts 6 of the tucking members are connected by flexible joints 7 in a generally circular pattern (FIG. 2).

An arm 10 is projected from the fulcrum supporting shaft of the topmost fulcrum supporting shaft 6, and a fluid pressure cylinder 8 is connected to the arm 10. Therefore, the operation of the fluid pressure cylinder 8 causes the tips of the tucking members 4 to turn simultaneously towards the center of the cylindrical frame around the fulcrum supporting shaft 6.

At the position corresponding to the center hole of the roll 1, a plug 14 having substantially the same diameter as that of the hole 1' projects from the frame 9, and the plug 14 is given an axial movement and slow rotational motion through a shaft 11. The shaft 11 of the plug 14 has a sliding base 12 and a fixed ring 19 fitted thereon. The sliding base 12 has pivotally attached thereto a number of radially extending main arms 16 equal to the number of tucking members 4.

The tip of each main arm 16 is provided with a rotary piece 17 having welded thereon a projecting member 13 and the main arm 16, the rotary piece 17, an arm 18 and an arm 20 form a parallelegram. The lower end of the arm 20 is pivotally attached to the fixed ring 19. Therefore, when the sliding base 12 is caused to advance on the shaft 11 by rotation of driving screws 24', the link mechanism of the projecting members 13 all expand radially at one time and the tips 13' of the projecting members are placed between the tucking members 4. Then if the sliding base 12 is caused to retract by reverse rotation of the driving screws 24', the main arm 16 and the projecting members 13 are brought more parallel to the shaft 11, that is they are brought into a folded state. The driving screw 24' is rotated by a motor (not shown) in a box 24.

In the device for wrapping the ends of rolls, the frame 9 is moved so as to position the fulcrum supporting shafts 6 of tucking members 4 near the end of the roll 1 which has been wound on its periphery with wrapping paper 2 by the roller 3 (FIG. 2(A)).

When the fulcrum supporting shafts 6 are positioned near the end of the roll 1, the cylinder 8 is operated to turn all the tucking members 4 inward at one time and the sliding base 12 is advanced to cause the projecting members 13 to rise and bring the tips 13' into contact with the inside of the cylinder of wrapping paper 2' projecting from the end of the roll 1.

Figure 3A:
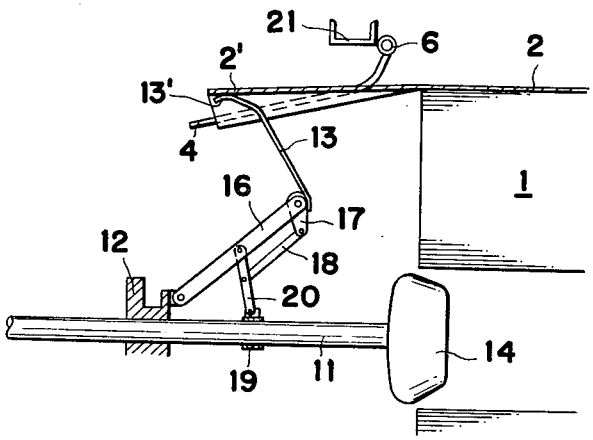
FIGS. 3(A)–3(D) are the illustrations of the device according to this invention showing the state of the wrapping paper as it is tucked in the ends of the rolls.
Figure 3B:
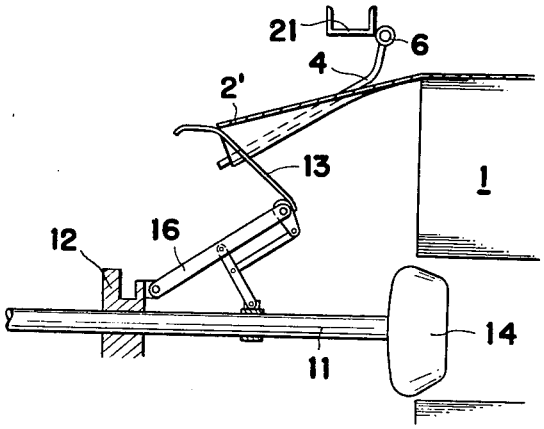

Therefore, the tucking members contact periphery of the cylinder of wrapping paper 2' projecting from the end of the roll 1 from the outside to produce groove portions, while the projecting members contact the cylinder of wrapping paper from the inside at points lying between the tucking members to produce ridge portions (FIG. 3(B)).

Once the cylinder of wrapping paper 2' has been contacted from both the outside and inside, the tucking members are caused to turn inward by further operation of the cylinder 8. Then, the sliding base 12 is caused to draw back so as to pucker up the projecting members. The operation of the projecting members is slightly delayed so that the cylinder of wrapping paper is always formed into grooves by the tucking members and into ridges by the projecting members.

Figure 3C:
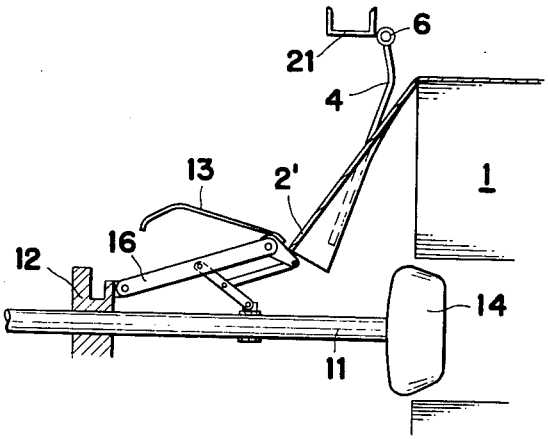
Figure 3D:
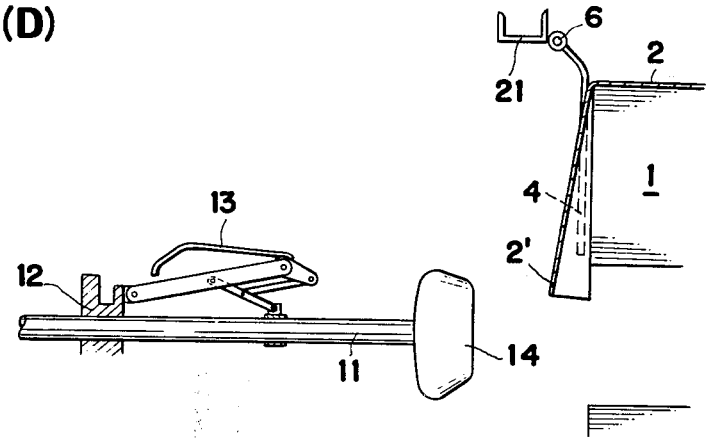
Figure 4:
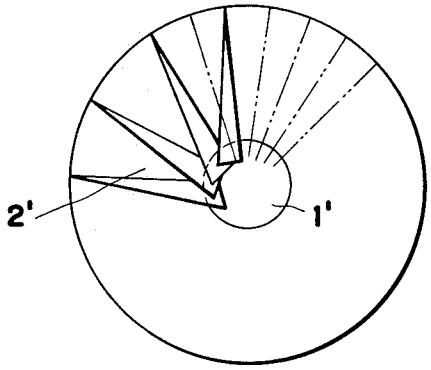
FIG. 4 illustrates the state of the wrapping paper tucked in the ends of the rolls.

Just before, the tucking members 4 contact the end of the roll (FIG. 3(C)), a cylinder 15 for drawing back the shaft 11 together with the sliding base 12 is put into operation and the projecting members 13 and the plug 14 are withdrawn from the cylinder of wrapping paper 2' (FIG. 3(D)). Therefore, only the tucking members 4 remain in pressing contact with the end of the roll and the ridges are maintained in the wrapping paper (see the right end of FIG. 1). The roll 1 is then rotated slightly so that the tucking members fold over the ridges and cause them to lie flat in one direction. Then the cylinder 15 is operated to cause the part of the folded wrapping paper which faces the hole 1' to be pushed into the hole by the plug 14 and thus complete the wrapping of the roll. The tucking members can be of rod or plate shape and can be made of plastic, wood or metal. They are of a length equal to or somewhat less than the thickness of the paper on the roll (from the surface of the center hole). When the structure shown on FIG. 5–FIG. 7 is used, the folds will be finished more neatly on the ends of the roll.

Figure 6:
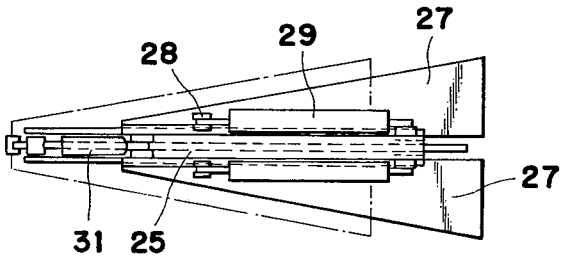
FIG. 6 is a plan view of the tucking members shown in FIG. 5.
Figure 5:
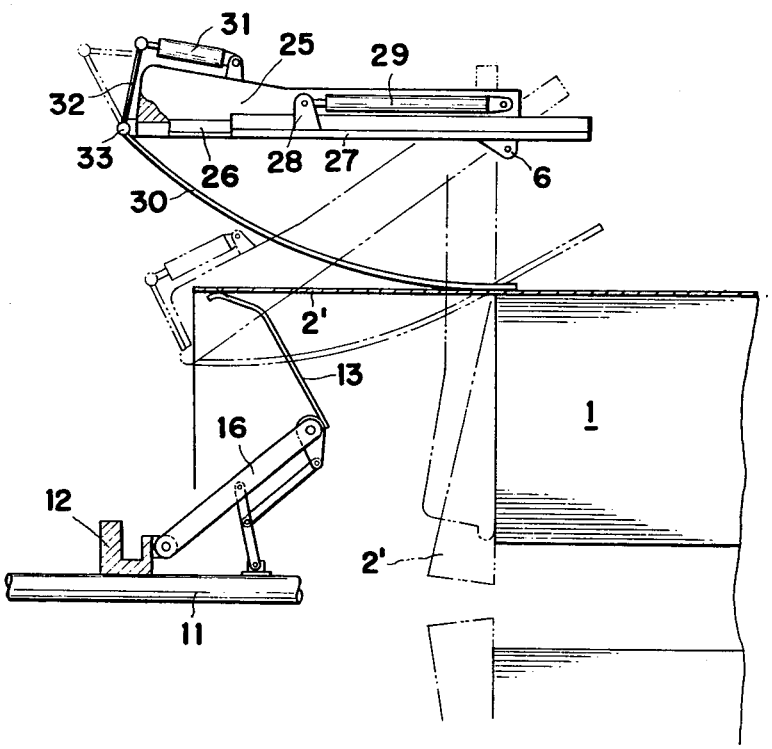
FIG. 5 is the enlarged front view showing another example of tucking members of the device for wrapping the ends of rolls according to this invention.
Figure 7:
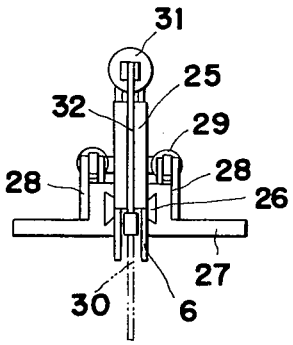
FIG. 7 is a side view of the tucking members shown in FIG. 5.

Referring to FIGS. 5 to 7, projecting rails 26 are provided on the both sides of a bar member 25 having a fin, and triangular plates 27 are slidably inserted into the projecting rails 26. For controlling the sliding motion of the triangular plates 27, a cylinder 29 is fixed on the bar member 25 and connected with triangular plates 27 through a bracket 28.

At the top of the bar member 25, an elastic wire 30 is supported by the shaft and rotated by the cylinder 31 placed at the tip of the bar member 25.

Figure 8A:
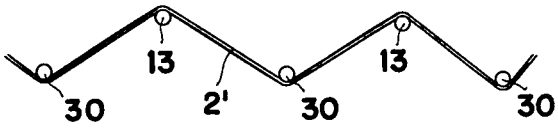
FIGS. 8(A)–8(C) are explanatory views showing the state of tucking when the tucking members in FIG. 5 are used.
Figure 8B:
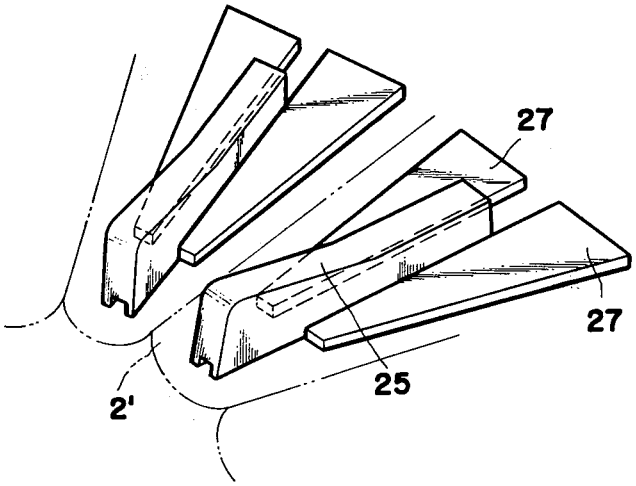
Figure 8C:
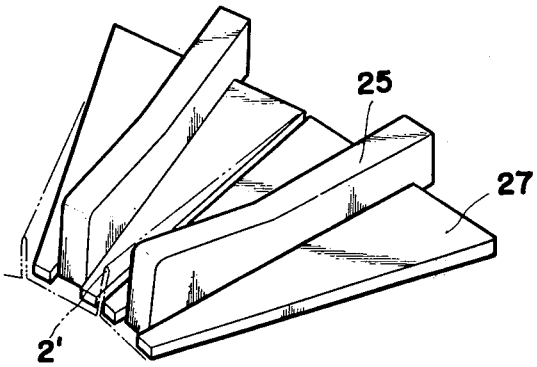

In case of using tucking members as mentioned above, a lever 32 is rotated by a cylinder 31 about a shaft 33 and a supporting shaft 6 is rotated by a cylinder (not shown) after the tip of the wire 30 contacts with the end of the roll 1. At the same time, the projecting members 13 in contact with the inside of the cylinder of wrapping paper 2' are puckered up gradually by drawing back the sliding base 12. Thus, at the end of the cylinder of wrapping paper, ridge and groove portions are formed as shown on FIG. 8(A). When the tucking members are further turned and the projecting members 13 are withdrawn from the wrapping paper, the tucking members remain in close contact with the end of the roll with the ridge portions maintained as shown in FIG. 8(B). At this time, the wire 30 is drawn into a groove provided at the bottom of the bar member 25. Appropriate gaps are left between the tucking members 14 in close contact with end of the roll. Therefore, when the cylinder 29 is operated, the triangular plates 27 on both sides of the bar member 25 are caused to slide towards the center along the projecting rail 26 to eliminate the gaps between triangular plates 27 and raise the ridges (FIG. 8(C)). In such state, the roll 1 is rotated and the ridges are laid towards the periphery. Therefore, the end of the wrapping paper is pushed into the hole 1' by the plug 14.

Figure 9:
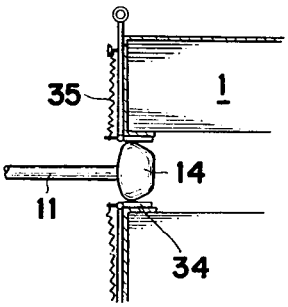
FIG. 9 is an explanatory view showing another example of the device for wrapping the ends of rolls by this invention.

Further, a flexible piece 34 is provided on the tip of the tucking members 4 as shown in FIG. 9. This piece 34 is normally held in extended state by means of a spring 35, and when the wrapping paper is pushed in by the plug 14, it is caused to bend into the hollow hole under the force of the plug 14. Through this action the piece 34 protects the edge of the hole and also makes the folds neat.

The projecting members 13 is made of a highly flexible wire material because the wrapping paper may be broken if the motions of the tucking members 14 and the projecting members 13 are not smoothly coordinated. The material of these pieces can be metal, plastic, wood, bamboo, etc.

In case of an actual operation, the most appropriate relationship between the motions of the tucking and projecting members can be obtained by experiments and calculations, and it is preferable to control the hydraulic cylinder-actuating motor so that the tucking and projecting members can work in accordance with such relationship.

The device for wrapping the ends of rolls according to this invention, as explained above, folds the cylinder wrapping paper projecting from the ends of the roll by supporting the cylinder from both the inside and the outside and thus is able to wrap the ends in neat folds. It is especially suitable for wrapping rolls having a larger diameter.

What is claimed is:

1. A device for wrapping up the ends of a roll in a wrapping paper which has been wrapped to encircle the roll and which being longer than the roll extends cylindrically from both ends thereof, which device comprises:

a set of tucking members at either end of said roll, said tucking members being disposed at given intervals on the outer peripheral surface of said wrapping paper extending cylindrically from the ends of said roll, wrapping paper operation means for simultaneously moving said tucking members toward the center of the ends of said roll, a set of projecting members at either end of said roll, said projecting members being disposed on the inner peripheral surface of said cylindrically protruding wrapping paper at positions falling between the tucking members, means for simultaneously puckering up said projecting members in proportion as said tucking members are moved toward the center of the ends of said roll and for causing said projecting members to escape from the inner surface of said cylindrically protruding wrapping paper before said tucking members come into contact with the ends of said roll, means for laying flat the wrapping paper ridged between the adjacent tucking members by said projecting members when said tucking members come into contact with the ends of said roll, and means for pushing into a central hole of said roll the portions of said wrapping paper which stop up said central hole when said ridged portions are laid in one direction.

2. The device according to claim 1, wherein said tucking members are formed in the shape of a triangle and come into radial contact with the ends of said roll.

3. The device according to claim 2, wherein each of said tucking members is provided with a pair of wings capable of moving toward the center of the ends of said roll after said tucking members come into contact with the ends of said roll.

* * * * *

UNITED STATES PATENT AND TRADEMARK OFFICE

CERTIFICATE OF CORRECTION

PATENT NO. : 4,184,307

DATED : January 22, 1980

INVENTOR(S) : Hiroshi Kataoka

It is certified that error appears in the above–identified patent and that said Letters Patent are hereby corrected as shown below:

Please insert the following Foreign Application Piority Data:

[30]--- September 5, 1977 [JP] Japan..... 52/105784

Signed and Sealed this

*Twenty-ninth* Day of *July 1980*

[SEAL]

*Attest:*

SIDNEY A. DIAMOND

*Attesting Officer*

*Commissioner of Patents and Trademarks*